US005148221A

United States Patent [19]

Gokita

[11] Patent Number: 5,148,221

[45] Date of Patent: Sep. 15, 1992

[54] IMAGE FORMING APPARATUS WITH TONER DENSITY CONTROL BASED ON THE MEDIUM SUPPLIED

[75] Inventor: Masami Gokita, Tokyo, Japan

[73] Assignee: Kabushiki Kaisha Toshiba, Kawasaki, Japan

[21] Appl. No.: 676,109

[22] Filed: Mar. 27, 1991

[30] Foreign Application Priority Data

Mar. 31, 1990 [JP] Japan ..... 2-085654

[51] Int. Cl.[5] ..... G03G 21/00

[52] U.S. Cl. ..... 355/246; 355/208

[58] Field of Search ..... 355/246, 208, 311, 245, 355/251; 118/656, 657

[56] References Cited

U.S. PATENT DOCUMENTS

| | | | |
|---|---|---|---|
| 4,101,214 | 7/1978 | Irie et al. | 355/256 |
| 4,397,542 | 8/1983 | Brodesser | 355/311 X |
| 4,951,088 | 8/1990 | Bonvallet et al. | 355/208 X |
| 4,969,011 | 11/1990 | Faull et al. | 355/208 |
| 4,974,024 | 11/1990 | Bares et al. | 355/246 |
| 5,005,049 | 4/1991 | Matsushita | 355/208 |

*Primary Examiner*—Joan H. Pendegrass

*Assistant Examiner*—Nestor R. Ramirez

*Attorney, Agent, or Firm*—Foley & Lardner

[57] ABSTRACT

An actual toner density of the two component developing agent in the developing device can be estimated based on a value Y obtained by the following equation:

$$Y = \frac{Yp \times Cp + Ye \times Ce}{Cp + Ce}$$

wherein Yp is the number of papers supplied to the developing device, Ye is the number of envelopes supplied to the developing device, Cp is a value proportional to changes in the toner density of the two component developing agent in the developing device when the image forming operation is carried out with paper and Ce is a value proportional to changes in the toner density of the two component developing agent in the developing device when the image forming operation is carried out with envelopes. Based on the above-described estimation, an appropriate amount of toner can be replenished into the developing device.

18 Claims, 14 Drawing Sheets

IMAGE FORMING APPARATUS WITH TONER DENSITY CONTROL BASED ON THE MEDIUM SUPPLIED

BACKGROUND OF THE INVENTION

1. Field of the Invention

The present invention relates, in general, to image forming apparatus. In particular, the invention relates to an image forming apparatus which uses electrostatic photography technology to form a visible image corresponding to an original document on a paper.

2. Description of the Related Art

In a conventional image forming apparatus which forms an image using an electrostatic photography technology, the information recorded surface of a document is scanned by a light beam and the light reflected from the information recorded surface is focused on the outer surface of an image carrier, e.g., a photosensitive drum, to form an electrostatic latent image on the image carrier. The electrostatic latent image formed on the surface of the image carrier is developed by the electrostatic adhesion of a developing agent to be a visible image.

In general, one of two different developing agents is used to develop the electrostatic latent image formed on the image carrier. One developing agent may be a two component developing agent, in which thermoplastic colored toner particles are mixed with carrier particles such as ferromagnetic particles. The other developing agent may be a single component developing agent in which each toner particle is integrated with a carrier particle.

The two component developing agent has a good environment-resisting ability, e.g., image density against high temperature or high humidity. This is because a high electrostatic charge can be produced by the mechanical friction between the toner particles and the carrier particles, in spite of high humidity. On the other hand, the one component developing agent has a good maintenance record during the operation of the image forming apparatus because of the integration of toner particles and carrier particles.

However, if the two component developing agent is used, it is necessary to maintain the mixture ratio between the carrier particles and the toner particles at a constant value to produce images of a constant image density. Thus, an auto-toner supply system is employed if the two component developing agent is used.

In the auto-toner supply system, a toner senser is used to detect the toner density of the two component developing agent stored in the developing device. When a low toner density is detected by the toner senser, the toner is replenished in the developing device.

In the conventional image forming apparatus employing the above-described auto toner supply system, the toner of the two component developing agent is given a prescribed electric charge against the electrostatic latent image formed on the surface of the image carrier. The toner of the two component developing agent is attached to the electrostatic latent image on the image carrier, as a toner image, when the electrostatic latent image is developed, and the toner image is transferred to an image forming medium, e.g., a paper sheet, in a transferring process. Thus, the toner in the two component developing agent is consumed every time the developing process is carried out.

To decrease the consumption of the toner described above, the toner which remains on the image carrier after the transferring process is completed is collected and returned to the developing device. Such a toner collecting operation is called as a toner recycling system.

In the above-described toner recycling system of the conventional image forming apparatus, if an image having a low image forming rate (area of images formed on the image forming medium/printable area of the image forming mediums) is repeatedly printed or copied, untransferred toner particles on the image carrier are collected on the developing device, and the collected toner particles are reused repeatedly. If envelopes are used as an image forming medium to be printed by the above-described image forming apparatus, the image forming rate of each envelope is low, e.g., 1~2% (where as the image forming rate of a paper document is about 5%). This is because, in general, only an address is printed on the envelope. Thus, the above-described toner particles are repeatedly collected and stirred in the developing device resulting in fine toner particles. Since fine toner particles gather to make a mass or group, the volume thereof is increased although the mass is the same as that in the original state, as a whole. Thus, the amount of two component developing agent which contacts the toner sensing unit is increased, resulting in an increased output of the toner sensing unit. The increase in the output of the toner sensing unit falsely indicates the same result as the decrease of the toner density of the two component developing agent stored in the developing device. Responding to this false result, unused toner is replenished to the developing device and the actual toner density in the developing deive becomes excessively high. The background of the image formed on the image forming medium, e.g., a paper, tends to be black, and thus, a fogged image may be formed on the image forming medium.

As described above, if a document having a low image forming rate, such as, e.g., an envelope, is continuously copied by the conventional image forming apparatus, an average toner particle size in the developing device tends to decrease. A particle size of the toner having a diameter of about 11 μm at an initial stage is decreased up to 9 μm (about 20% decrease) after 15,000 envelopes are copied. Then, the volume of the toner in the developing device is increased, in contrast with the decrease in an average particle size of the toner, and thus, the output of the toner sensing unit is increased to replenish unused toner into the developing device. As a result, a fogged image may be formed on the envelope. Furthermore, if the average particle size of the toner becomes smaller, the image formed on the document tends to be fogged.

SUMMARY OF THE INVENTION

Accordingly, it is an object of the present invention to precisely replenish a toner to the developing device of an image forming apparatus which employs a toner recycling system.

To accomplish the above-described object, an image forming apparatus includes a supply section for supplying a first image forming medium and a second image forming medium different from the first image forming medium, an image forming section, including a developing device in which a two component developing agent including a toner and a carrier is stored at a prescribed toner density, for selectively forming a visible image on the first image forming medium and the second image forming medium with the toner, a storing section for storing the toner of the two component developing agent, a toner supplying section for replenishing the toner in the storing section to the developing device, a count unit for respectively counting the number of first image forming mediums and second image forming mediums supplied to the image forming section, a memory section for storing data of a relationship of the prescribed voltage value data, which is proportional to changes in the actual toner density in the developing device, against the number of first image forming mediums (Cp) supplied to the image forming section and the number of second image forming mediums (Ce) supplied to the image forming section, an estimating section for estimating the actual toner density in the developing device based on the respective count value of first and second image forming mediums in the counting section and the data in the memory section, and a control section responsive to the estimating section for activating the toner supply section to regulate the actual toner density in the developing device.

BRIEF DESCRIPTION OF THE DRAWINGS

These and other objects of the present invention will become more apparant and more readily appreciated from the following detailed description of the presently preferred embodiment of the invention, read in conjunction with the accompanying drawings wherein.

DETAILED DESCRIPTION OF THE PREFERRED EMBODIMENT

Figure 1:
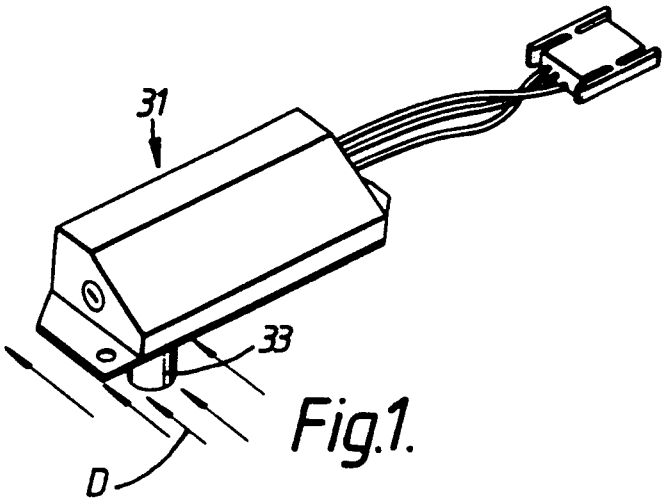
FIG. 1 is a perspective view illustrating a conventional toner sensing unit.

Referring to the accompanying drawings, one embodiment of the present invention will now be described. However, in the drawings, the same numerals are applied to similar elements, and therefore the detailed descriptions thereof are not repeated.

An image forming apparatus of one embodiment of the present invention is used as a printer to print an image on an image forming medium, e.g., a paper or an envelope, in accordance with an image information sent from an external host apparatus, e.g., a computer, a wordprocessing apparatus, etc., through a transmitting controller.

A conventional toner sensor 31 shown in FIG. 1 is disposed in a developing device (described hereafter). When a sensing unit 33 of toner sensor 31 contacts the two component developing agent D, sensing unit 33 generates an output voltage corresponding to the toner density (toner/carrier ratio) of the two component developing agent D. The following TABLE I showns a relationship between the toner/carrier ratio and the output voltage of sensing unit

TABLE I

| Toner/Carrier ratio (% by wt) | 1.5 | 3.5 (Reference) | 4.5 |
|---|---|---|---|
| Output Voltage of sensing unit (V) | greater than 4.0 | 2.0 | 0.4 ~ 1.2 |

Figure 2:
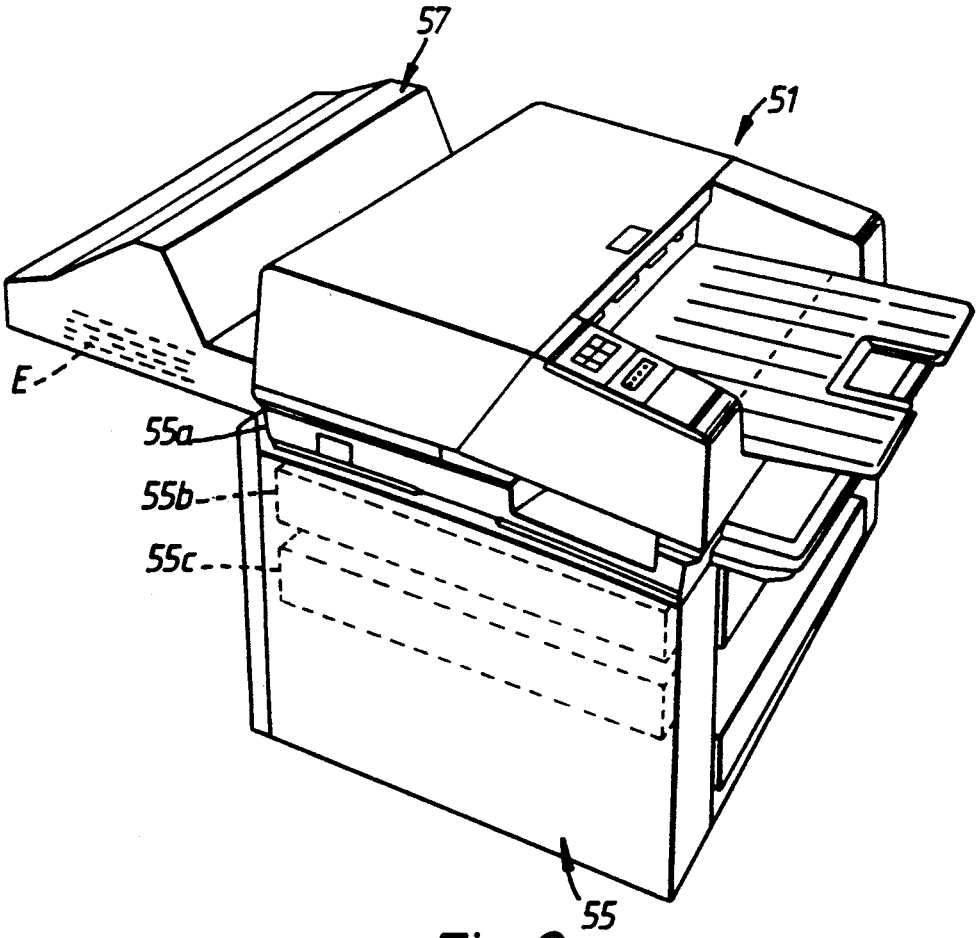
FIG. 2 is a perspective view illustrating an image forming apparatus of one embodiment of the present invention.
Figure 3:
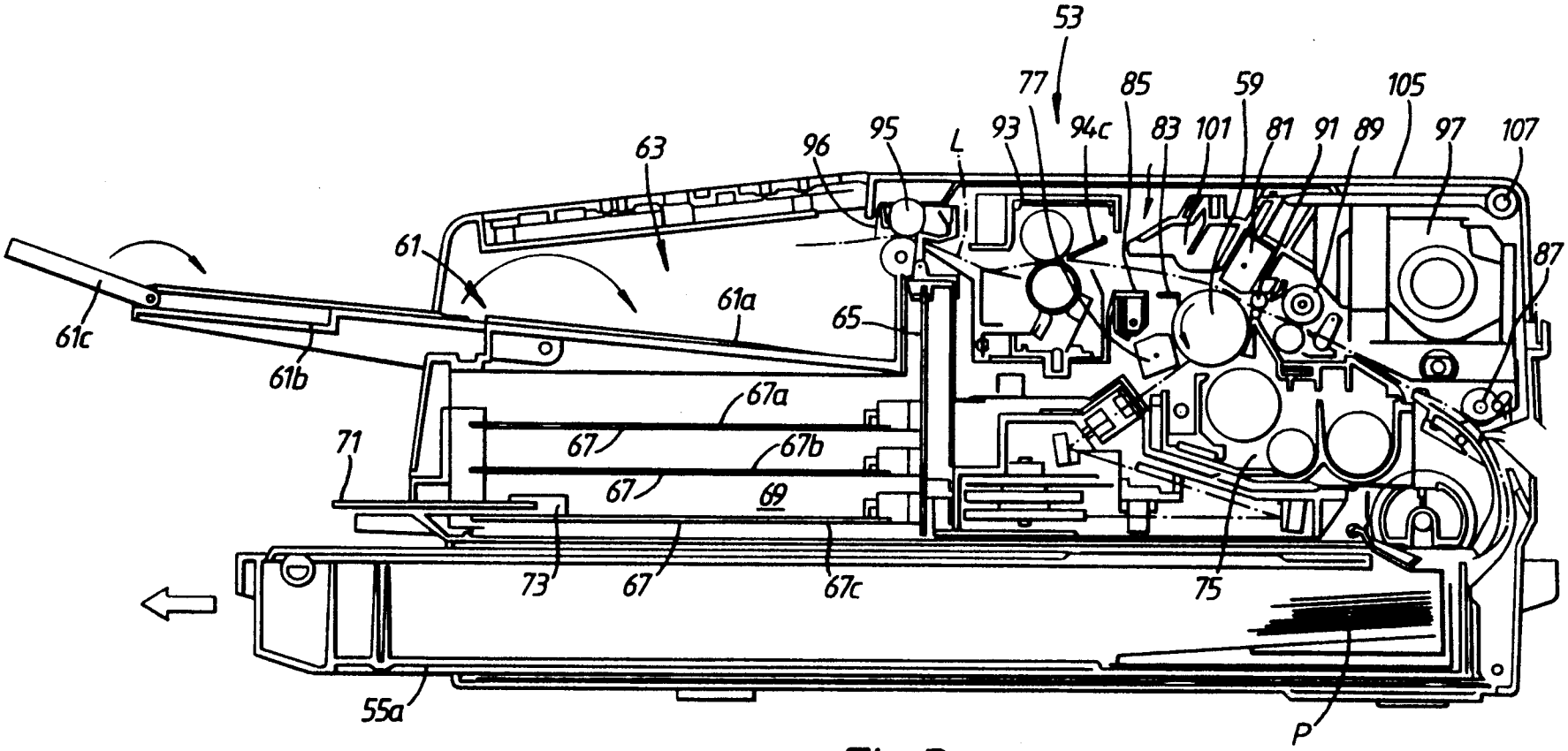
FIG. 3 is a sectional view illustrating the image forming apparatus shown in FIG. 2.
Figure 9:
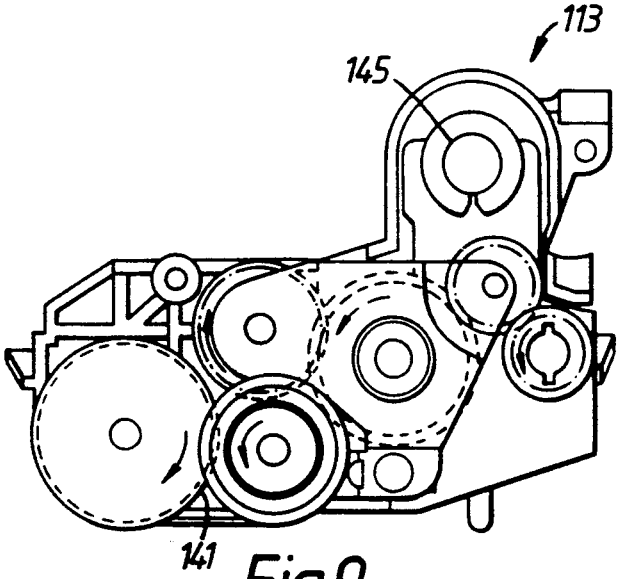
FIG. 9 is a partial cross sectional side view of the process cartridge.

As shown in FIGS. 2 and 3, an image forming apparatus 51 of this embodiment includes a process unit 53, a paper supply unit 55 and an envelope supply unit 57. process unit 53 is mounted on paper supply unit 55. A first paper supply cassette 55*a* is inserted into the lower portion of process unit 53, as shown in FIG. 2. Second and third paper supply cassettes 55*b* and 55*c*, indicated in a dotted line in FIG. 9, are arranged in paper supply unit 55 in a vertical direction to selectively supply a different sized paper therefrom. A paper P taken out from one of first, second and third paper supply cassettes 55*a*, 55*b* and 55*c* is fed to the transfer area of a photosensitive drum (image carrier) 59 on which a visible image is formed with a toner. The visible image is transferred to the paper P and the paper P is finally discharged to a tray 61. An envelope E stored in envelope supply unit 57 is also fed to photosensitive drum 59. The visible image formed on photosensitive drum 59 is transferred to envelope E, and envelope E is finally discharge to tray 61 after the image on envelope E is fixed. As shown in FIG. 3, tray 61 includes a first tray portion 61*a* fixed in a sheet receiving section 63 formed in parallel to process unit 53 and a second tray portion 61*b* rotatably pivotted at the edge portion of first tray portion 61*a*. Tray 61 also includes a U-shaped auxiliary tray portion 61*b*. Second tray portion 61*b* and auxiliary tray portion 61*c* may selectively be rotated to be unfolded. Thus, tray 61 is manually adjustable to the size of a sheet to be printed.

A main control base plate 65 is arranged to a space between process unit 53 and sheet receiving section 63. A plurality of sub control base plates 67 which add several functions are arranged in a control plate housing section 69 located under sheet receiving section 63. In response to the function added, e.g., extent of a usable typeface or geometrical symbol, etc., three different sub control base plates 67*a*, 67*b* and 67*c* are selectively provided in control plate housing section 69. In addition, a function adding IC-card 71 may be inserted into a connector 73 provided on the edge portion of one of the control base plate 67*c* disposed at the lower-most position in control plate housing section 69, to add a further function.

In the above-described image forming apparatus 51, a two component developing agent including a toner and a carrier is used to develop the electrostatic latent image formed on photosensitive drum 59. The toner of the two component developing agent is supplied to developing device 75 arranged in process unit 53 of image forming apparatus 51. The carrier of the two component developing device is also provided to the developing device 75 beforehand. The toner density of the two component developing agent in developing device 75 is controlled within a predetermined range to maintain the image density formed on paper P or envelope E at a constant value. Thus, the conventional toner sensor 31 shown in FIG. 1 is arranged in developing device 75 to detect changes in the toner density of the two component developing agent in developing device 75.

The construction of process unit 53 will now be described with reference to FIGS. 10 and 11. Process unit 53 carries out electrographic processes including a charging, an illuminating (scanning), a developing, a transferring, a cleaning and a fixing. In process unit 53, photosensitive drum 59 is disposed at a substantially central portion of process unit 53. process unit 53 includes a charger 77 for charging the surface of photosensitive drum 59, an illuminating device 79 for forming an electrostatic latent image on photosensitive drum 59 by scanning, and a magnetic brush type developing device 75 for developing the latent image on photosensitive drum 59, as a visible image, by applying toner. Developing device 75 also carries out a cleaning process to clean the surface of photosensitive drum 59. The toner on the surface of photosensitive drum 59 which remains after the last transferring process is removed and collected in developing device 75, to be reused. Process unit 53 further includes a transfer charger 81 for transferring the developed latent image on photosensitive drum 59 to paper P or envelope E taken out from the corresponding units 55 and 57. The above-described devices 77, 79, 75 and 81 are arranged in succession around photosensitive drum 59. A memory erasing device 83 composed of a brush element is disposed between transfer charger 81 and charger 71 to erase the latent image formed on photosensitive drum 59, and a pre-illuminating lamp 85 is also disposed between memory erasing device 83 and charger 77.

A paper conveying path L, indicated in a dot and dashed line, is established from paper supply unit 55 and envelope supply unit 57 to sheet receiving section 63 through a space 81*a* (an image transferring space) between photosensitive drum 59 and transfer charger 81.

Figure 4:
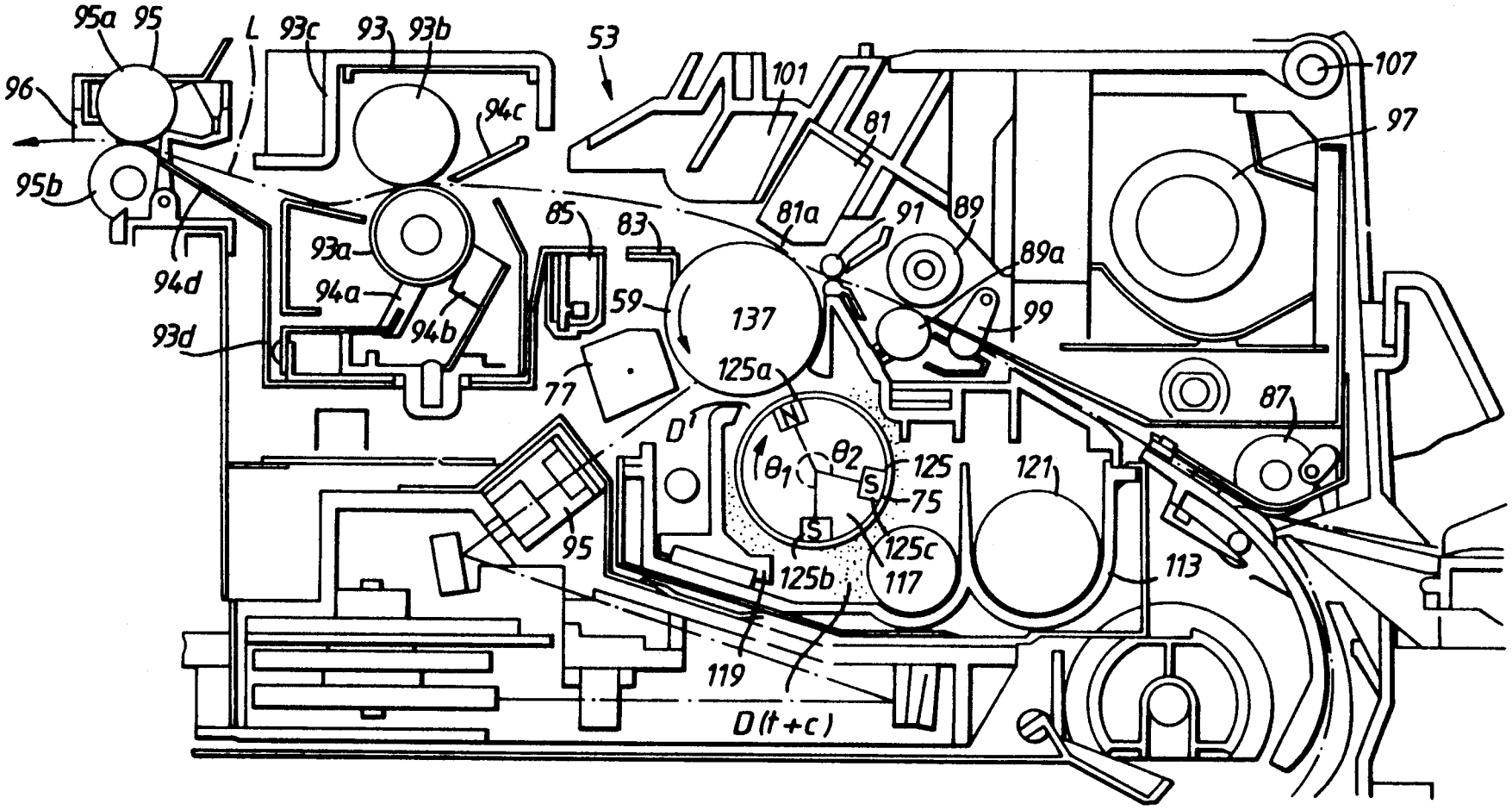
FIG. 4 is an enlarged sectional view illustrating a process unit of the image forming apparatus shown in FIG. 3.

A pair of conveying rollers 87, a pair of aligning rollers 89 and a pair of conveying rollers 91 are arranged along paper conveying path L at the sheet lead-in side of transfer charger 81. A fixing unit 93 and a sheet discharge roller unit 95 are also disposed at the sheet lead-out side of transfer charger 81 along sheet conveying path L, as shown in FIG. 4.

A toner supply cartridge 97 is arranged above the pair of conveying rollers 87 to supply toner to developing device 75.

An aligning switch 99 is disposed close to the aligning rollers pair 89 and a conveying guide 101 is arranged adjacent to transfer charger 81.

When an image forming signal is issued from the external apparatus (not shown), photosensitive drum 59 is rotated to be charged by charger 77. Then, illuminating device 79 illuminates the surface of photosensitive drum 59 by the scanning of a light beam modulated in accordance with an image information including dotted image data fed from the external apparatus. An electrostatic latent image corresponding to the dotted image data is formed on photosensitive drum 59. The electrostatic latent image on photosensitive drum 59 is developed with the toner in the electromagnetic brush D of the developing agent in developing device 75, as shown in FIG. 4. In response to this developing process, paper P fed from paper supply unit 55 or envelope E taken out from envelope supply unit 57 is conveyed to photosensitive drum 59 through aligning rollers pair 89. Then, the developed image on photosensitive drum 59 is transferred to paper P or envelope E by transfer charger 81.

Paper P or envelope E on which the developed image is transferred is conveyed to fixing unit 93 along paper conveying path L and the transferred image is fixed by fixing unit 93. After this fixing process, paper P or envelope E is discharged to tray 61 through sheet discharge roller unit 95.

The above-described fixing unit 93 includes a heat roller 93*a* and a pressure roller 93*b* forcibly contacting heat roller 93*a*. The transferred image on paper P or envelope E is fixed when paper P or envelope E passes through between heat roller 93*a* and pressure roller 93*b*. Heat roller 93*a* and pressure roller 93*b* are surrounded by an upper casing 93*c* and a lower casing 93*d* to maintain a suitable fixing temperature in fixing unit 93. A cleaner 94*a* is in contact with the surface of heat roller 93*a* to clean the remains on the surface of heat roller 93*a*. A temperature sensor 94*b*, e.g., thermistor, is also in contact with the surface of heat roller 93*a* to detect the temperature of heat roller 93*a*. A sheet guide 94*c* is arranged close to the sheet leat-in side of heat roller 93*a* to guide paper P or envelope E to the contact portion of heat roller 93*a* and pressure roller 93*b*. At the sheet discharge side of heat roller 93*a*, a second sheet guide 94*d* is arranged to lower casing 93*d* to guide paper P or envelope E from fixing unit 93 to sheet discharge roller unit 95.

Sheet discharge roller unit 95 includes an upper roller 95*a* and a lower roller 95*b* to convey paper P or envelope E from fixing unit 93 to sheet receiving section 63. A discharge brush 96 is provided at the sheet discharge side of sheet discharge roller unit 95 to discharge the electric charges on the surface of paper P or envelope E by contacting the surface of paper P or envelope E on which the image is fixed.

As shown in FIG. 3, a rotatable top cover 105 is pivotably arranged to the upper side of image forming apparatus 51 to open or close the upper side of process unit 53. Transfer charger 81, conveying guide 101 and discharge brush 96 and upper roller 95*a* of sheet discharge roller unit 95 are fixed on the inner surface of top cover 105. Top cover 105 has a rotational axis 107 provided at the corner of the upper side of image forming apparatus 51. Thus, top cover 105 may be rotated with transfer charger 81, conveying guide 101, discharge brush 96 and upper roller 95*a* at a maximum opening angle of 120° around rotational axis 107 for the inspection.

Image forming apparatus 51 of this embodiment employs a reversal developing method and simultaneously carries out the developing process and the cleaning process in which the toner remaining on photosensitive drum 59 after the last transfer process is removed.

In this embodiment, photosensitive drum 59, developing device 75, charger 77 and memory erasing device 73 are assembled as one block to form a process cartridge.

Thus, the process cartridge is easily changed to a new one when the operational life thereof is ended.

Figure 5:
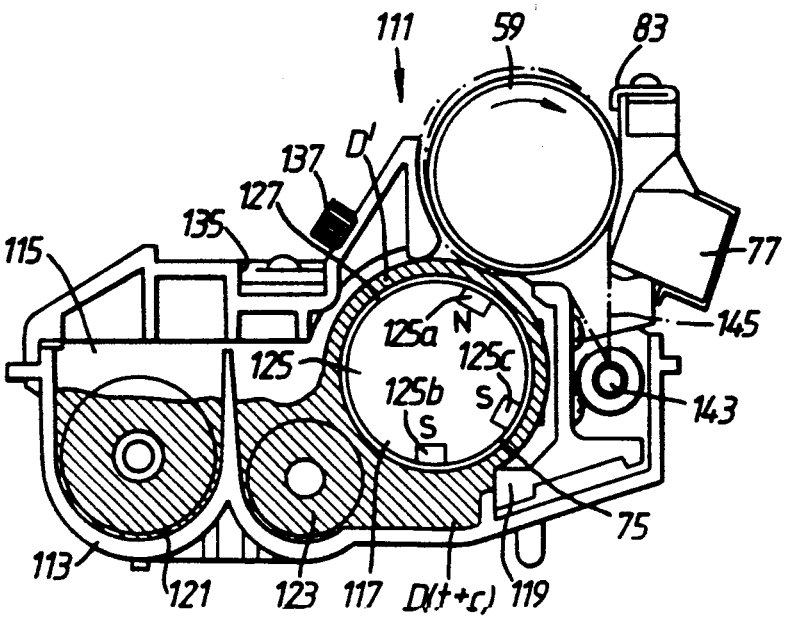
FIG. 5 is an enlarged sectional view illustrating a process cartridge of the process unit shown in FIG. 4.

The construction of process cartridge is now described in more detail. As shown in FIG. 5, process cartridge 111 includes a casing 113 in which a toner storing section 115 is formed. The toner t is stored in toner storing section 115. Developing device 75 is also arranged in casing 113. A developing roller 117 is disposed in developing device 75 to be opposite to photosensitive drum 59. The two component developing agent D (t+c) including the toner (t) and the carrier (c) is stored in developing device 75. A doctor blade 119 is arranged in developing device 75 to regulate the thickness of a developing agent magnetic brush D' formed on the circumferential surface of developing roller 117. First and second stirrer 121 and 123 are respectively arranged in toner storing section 115 and developing device 75 to stir the toner t stored in toner storing section 115 and the toner t and the carrier c in developing device 75.

Developing roller 117 includes a magnetic roll 125 having triple magnetic pole sections 125*a*, 125*b* and 125*c*, and a nonmagnetic movable sleeve 127 enveloping the outer surface of magnetic roll 125. Nonmagnetic movable sleeve 127 is rotated in a clockwise direction in FIG. 5. One of the triple magnetic pole sections 125*a* opposite to photosensitive drum 59 is an N-pole, and other magnetic pole sections 125*b* and 125*c* are S-poles. An angle $\theta 1$ between magnetic pole sections 125*a* and 125*b* shown in FIG. 11 at the center of magnetic roll 125 is 150° and an angle $\theta 2$ between magnetic pole sections 125*a* and 105*c* is 120°. Thus, the latent image on photosensitive drum 59 is developed by a voltage difference between the electric charged voltage of photosensitive drum 59 caused by a reverse developing method and the developing bias applied to developing agent magnetic brush D'. At this time, the toner t which remains on the surface of photosensitive drum 59 at the last developing process is simultaneously removed and collected by the mechanical scratch force caused by the developing agent magnetic brush D' formed on developing roller 117.

Figure 6:
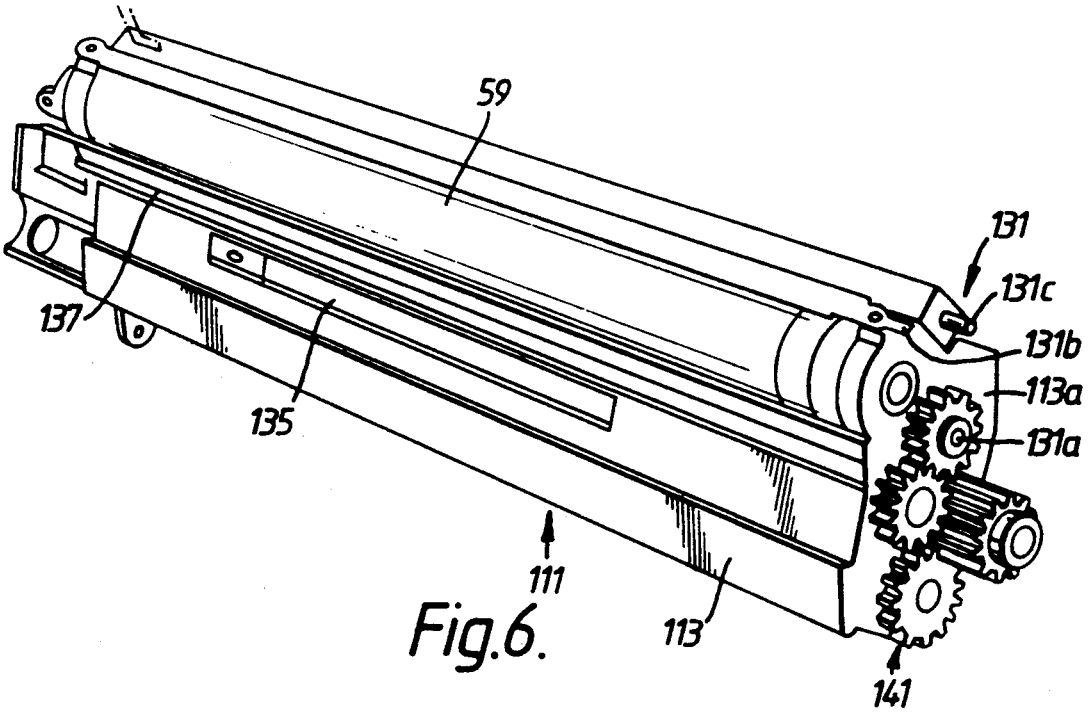
FIG. 6 is an enlarged perspective view of the process cartridge shown in FIG. 5.

As shown in FIG. 6, a power supply section 131 is formed at one of the opposite sides 113*a* of casing 113. Power supply section 131 includes a first supply 131*a* for supplying power to developing device 75, a second supply 131*b* for supplying power to memory erasing device 83 and a third supply 131*c* for supply power to charge 77. Each supply 131*a*, 131*b* or 131*c* projects from the one of the opposite sides 113*a*. When process cartridge 111 is inserted into a proper position in process unit 53, each supply 131*a*, 131*b* or 131*c* is respectively inserted into the corresponding power supply connectors (not shown) provided in process unit 53.

Figure 7:
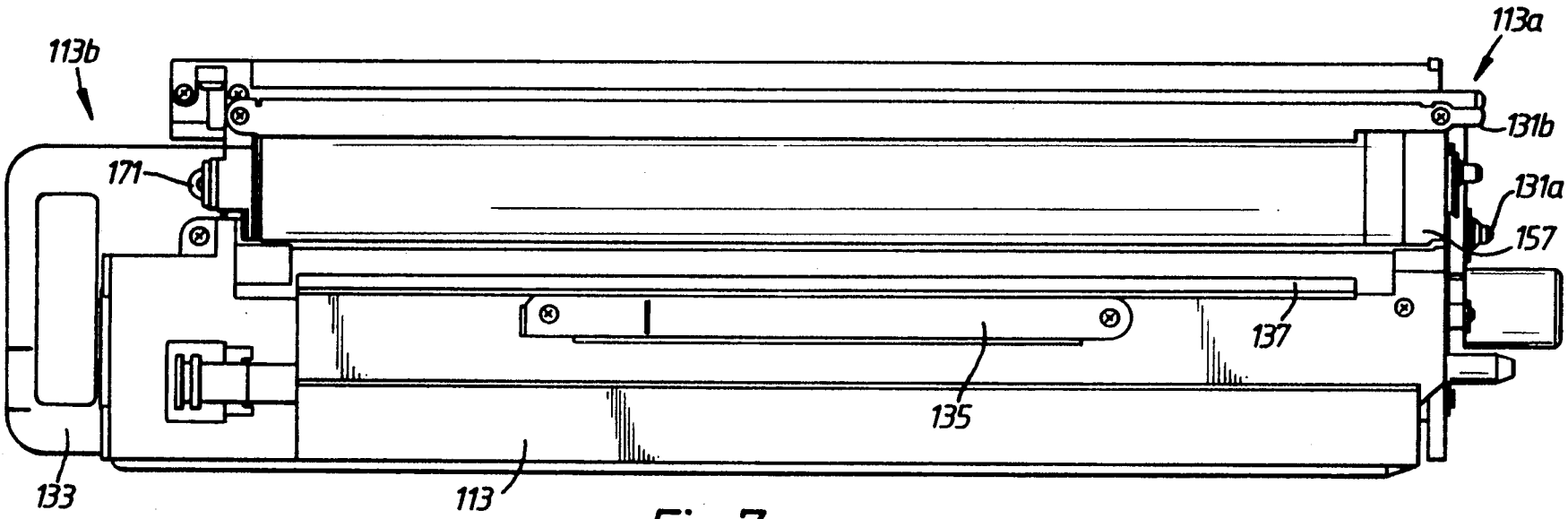
FIG. 7 is an elevational view of the process cartridge shown in FIG. 6.
Figure 8:
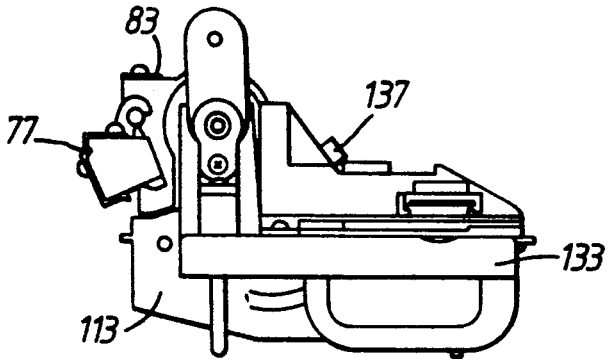
FIG. 8 is a side view of the process cartridge shown in FIG. 7.
Figure 14:
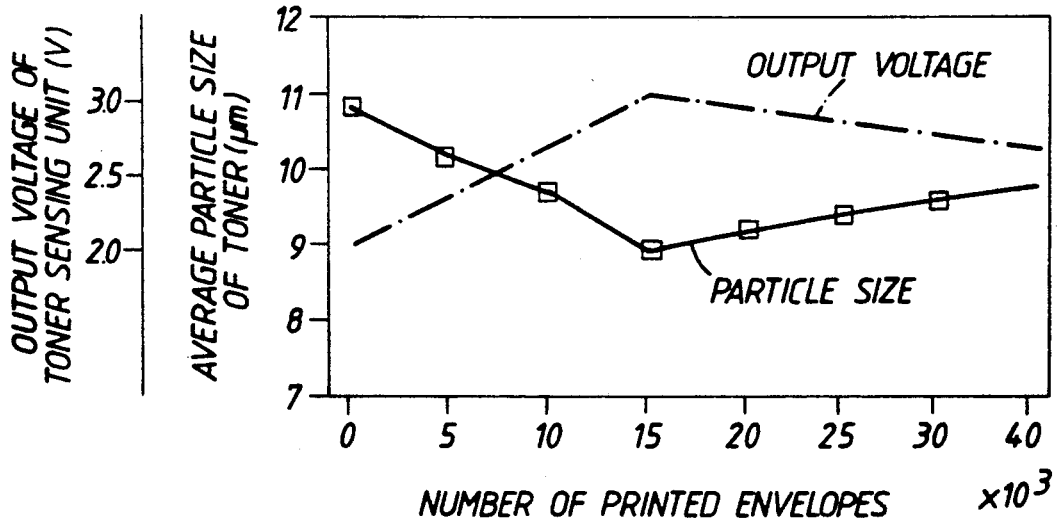
FIG. 14 is a graph showing a relationship between the number of printed envelopes and the particle size of the toner in the developing device or the output voltage of the toner sensing unit.
Figure 15:
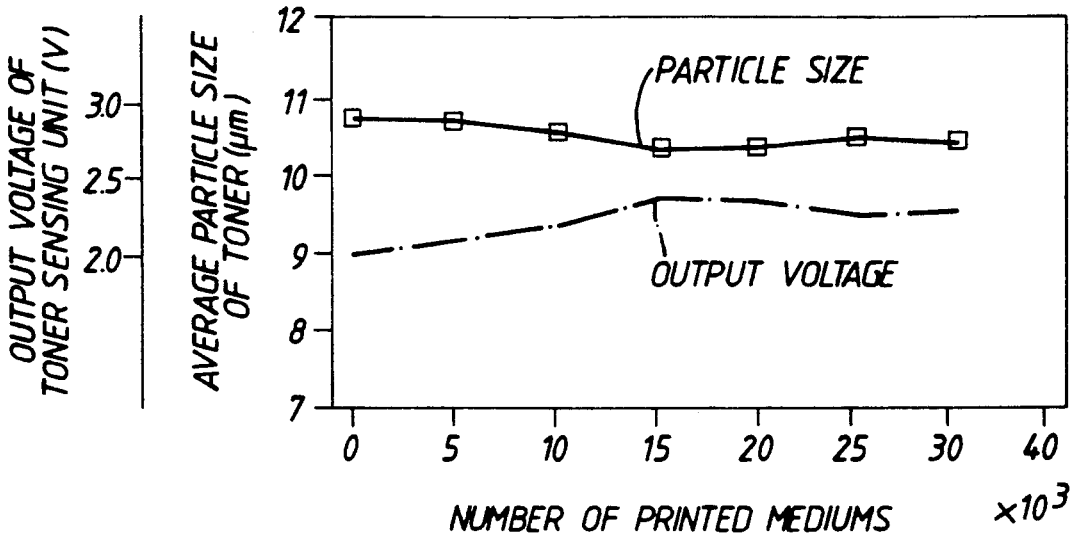
FIG. 15 is a graph showing a relationship between the number of printed papers and envelopes and the particle size of the toner in the developing device or the output voltage of the toner sensing unit.

A handle 133 is formed at the other side 113*b* of casing 113 to easily insert process cartridge 111 into image forming apparatus 51, as shown in FIGS. 14 and 15. A retractable handle 135 is also provided to casing 113 of process cartridge 111 to carry process cartridge 111 when process cartridge 111 is taken out from image forming apparatus 51, as shown in FIGS. 6 and 7. A cleaning brush 137 shown in FIGS. 4, 5, 6, 7 and 8 is arranged on casing 113 close to retractable handle 135 so that it is in contact with lower roller 89*a* of aligning rollers pair 89 to clean the surface of lower roller 89*a* when process cartridge 111 is inserted into a proper position in process unit 53, as shown in FIG. 11.

As shown in FIGS. 6 and 9, a gear block 141, each block element of which is connected to nonmagnetic movable sleeve 127, first or second stirrer 121 or 123, or a take-up shaft 143, is provided at the other side 113*b* of casing 113. Take-up shaft 143 is rotatably supported close to doctor blade 119 to take up a protection sheet 145 of photosensitive drum 59, as shown in FIG. 5. When gear block 141 is coupled with a driving gear (not shown) provided in process unit 53, nonmagnetic movable sleeve 127, first and second stirrers 121 and 123 and take-up shaft 143 are respectively rotated.

Figure 10:
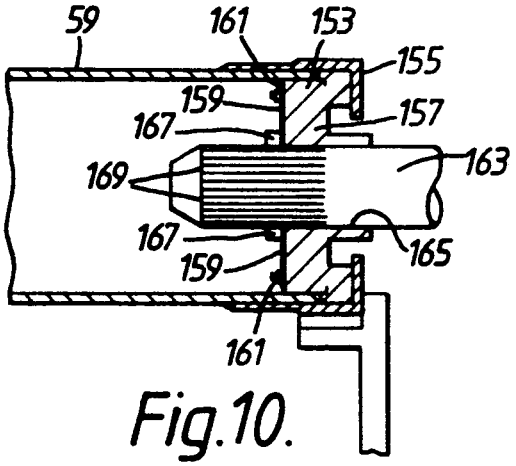
FIG. 10 is an enlarged sectional partially schematic view of the photosensitive drum.

As shown in FIG. 10, a flange 153 is attached to one of the ends of photosensitive drum 59. Flange 153 includes a plated metallic cap 155, a bearing member 157 inserted in cap 155, and a support member 159 fixed on the surface of bearing member 157 by a fixing member 161. When process cartridge 111 is assembled in process unit 53, a drum driving shaft 163 disposed in process unit 53 is inserted into photosensitive drum 59 through a hole 165 formed in flange 153. At this time, a plurality of plate-shaped connectors 167 projecting from bearing member 157 is coupled with a plurality of grooves 169 formed in the circumferential surface of drum driving shaft 163 to transmit the driving force of drum driving shaft 163 to photosensitive drum 59. A flange (not shown) similar to flange 153 is also attached to the other end of photosensitive drum 59, and photosensitive drum 59 is rotatably supported by casing 113 through a pin 171 shown in FIG. 7.

Figure 11:
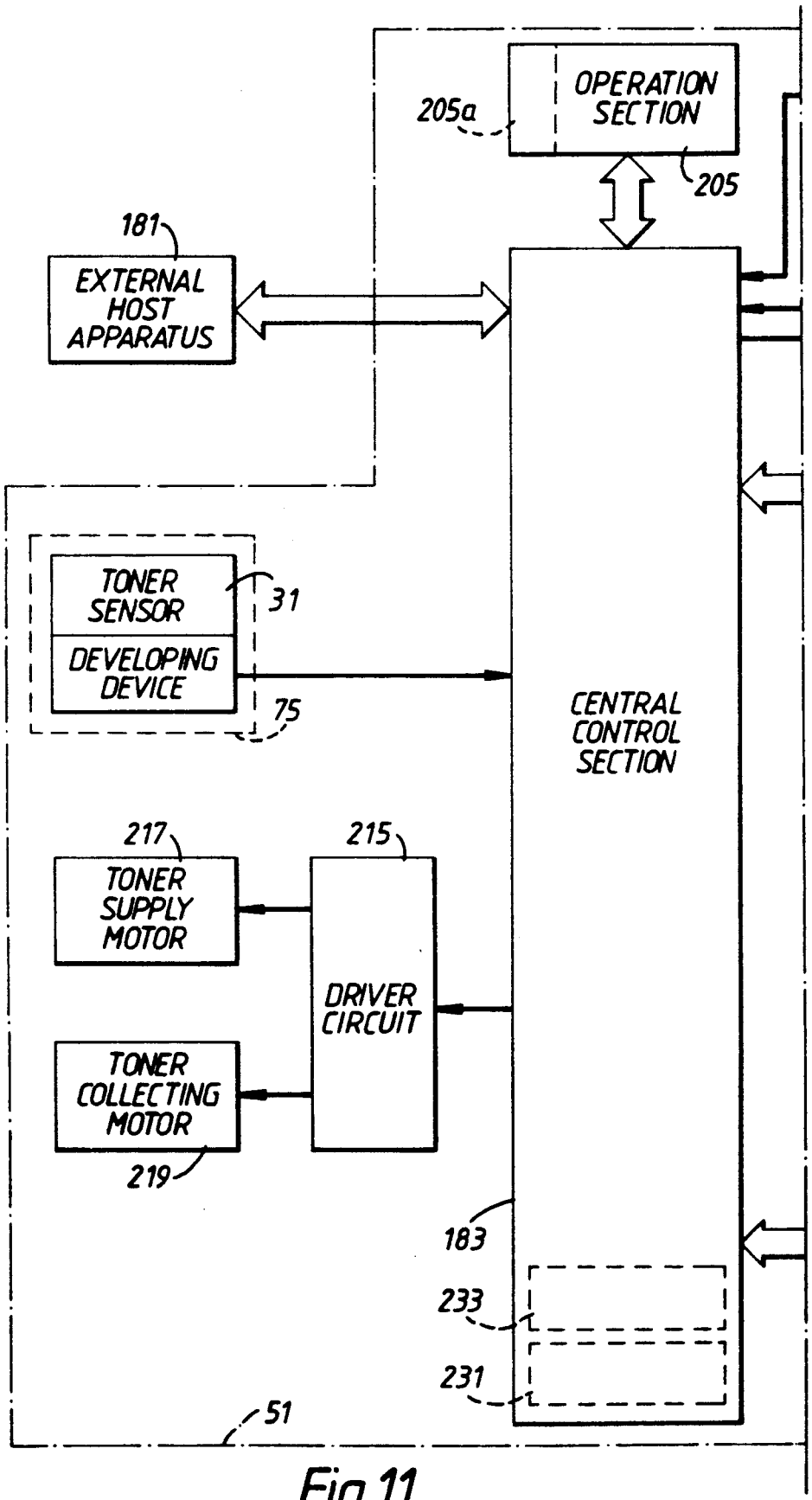
FIG. 11 is a block diagram illustrating an operational construction of the image forming apparatus shown in FIGS. 2 and 3.
Figure 11:
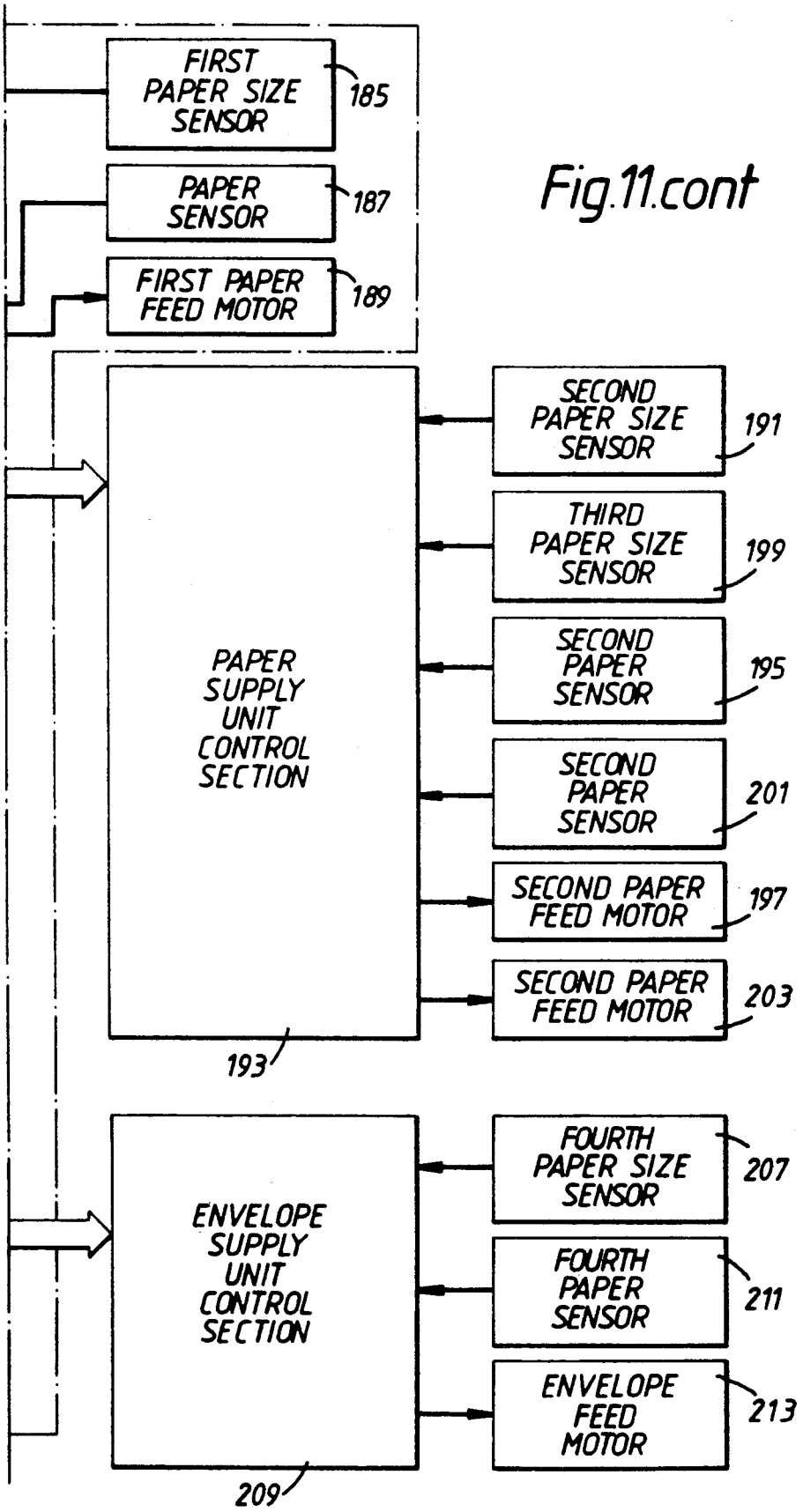

As shown in FIG. 11, an external host apparatus 181 outputs a control signal and an image signal to a central control section 183 arranged in image forming apparatus 51. A detection signal from a first paper size sensor 185 detecting the size of a paper P stored in first paper supply cassette 55*a* is input into central control section 183. A paper sensor 187 detects existence of paper P in first paper supply cassette 55*a* and outputs a detection signal to central control section 183. Based on each detection signal from first paper size sensor 185 and paper sensor 187, central control section 183 controls the operation of a first paper feed motor 189 to feed paper P in first paper supply cassette 55*a* to photosensitive drum 59 when a printing command is fed from host apparatus 181 to central control section 183.

A second paper size sensor 191 detects the size of a paper P stored in second paper supply cassette 55*b* and outputs a detection signal to a paper supply unit control section 193. A second paper sensor 195 detects existence of paper P in second paper supply cassette 55b and sends a detection signal to paper supply unit control section 193. Based on each detection signal from second paper size sensor 191 and second paper sensor 195, paper supply unit control section 193 controls the operation of a second paper feed motor 197 to take out paper P in second paper supply cassette 55b. Since each operation of a third paper size sensor 199 and a third paper sensor 201 is the same as that of second paper size sensor 191 and second paper sensor 195, the operations thereof are not repeated. Based on the detection results of third paper size sensor 199 and third paper sensor 201, a third paper feed motor 203 is controlled by paper supply unit control section 193 to take out paper P in third paper supply cassette 55c. Paper supply unit control section 193 also is controlled by central control section 183 on the basis of the operation command from an operation section 205 or external host apparatus 181.

A fourth paper size sensor 207 detects a size of envelope E stored in envelope supply unit 57, and outputs a detection signal to an envelope supply unit control section 209. A fourth paper sensor 211 detects existence of envelope E in envelope supply unit 57, and outputs a detection signal to envelope supply unit control section 209. Based on each detection signal from fourth paper size sensor 207 and fourth paper sensor 211, an envelope feed motor 213 is controlled by envelope supply unit control section 209 to take out envelope E in envelope supply unit 57. Envelope supply unit control section 209 is also controlled by central control section 183 in accordance with the operation command from operation section 205 or external host apparatus 181.

The output signal from toner sensor 31 shown in FIG. 1, indicating the toner density in developing device 75 is fed to central control section 183 through developing device 75. When the toner density in developing device 75 is below a prescribed range, central control section 183 outputs an ON-signal to a driver circuit 215 to energize a toner supply motor 217. Thus, the toner stored in toner supply cartridge 97 shown in FIG. 4 is replenished to developing device 75.

Central control section 183 controls the operation of a toner collecting motor 219 through driver circuit 215 to collect the toner which still remains on the surface of photosensitive drum 59 after the transfer process is executed.

Central control section 183 has a toner density control function. The toner density control mechanism of image forming apparatus 51 will be described with reference to FIG. 12.

When the output signal TDs corresponding to the toner density in developing device 75 is fed from toner sensor 31 to central control section 183, central control section 183 compares the output signal TDs with a prescribed value, e.g., an initial voltage value of the toner. If the voltage value of the output signal TDs is greater than the prescribed value, the toner density in developing device 75 is determined to be low. Central control section 183 drives toner supply motor 217 through driver circuit 215 to replenish the toner in a toner supply cartridge 97 to developing device 75. A shutter 221 provided between developing device 75 and toner supply cartridge 97 is opened by toner collecting motor 219 during the copying operation. However, shutter 221 is closed by toner collecting motor 219 to prevent the toner in developing device 75 from spilling out of developing device 75 when the user exchanges the empty toner supply cartridge 97 for a new one. Toner collecting motor 219 is also operated to collect the toner on photosensitive drum 59 to developing device 75 after the transfer operation. When toner collecting motor 219 rotates in a clockwise direction, an one-way clutch 223 is rotated to feed the toner to a drum cleaner cartridge 225 collected from photosensitive drum 59 to developing device 75 through a conventional toner recovery mechanism 227.

Figure 13:
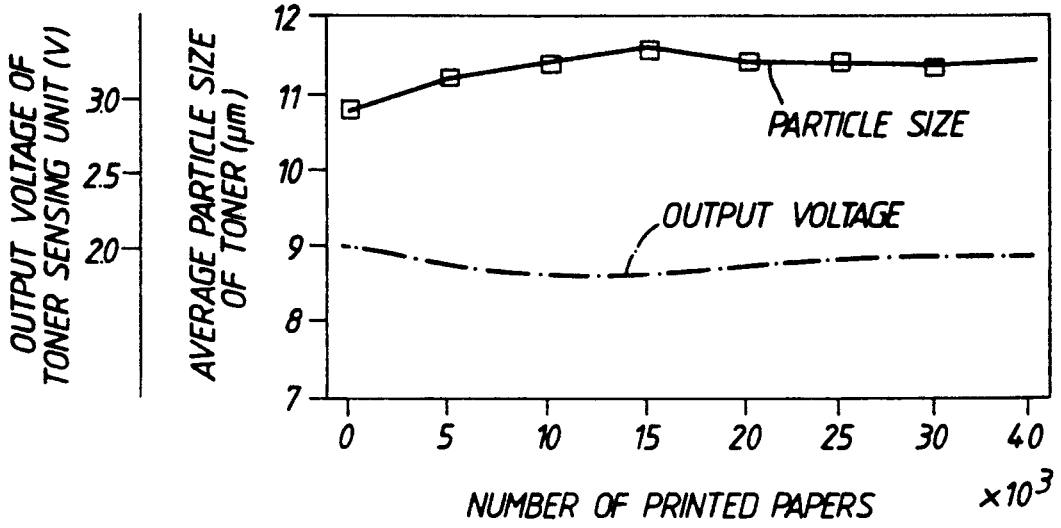
FIG. 13 is a graph showing a relationship between the number of printed papers and the particle size of the toner in the developing device or the output voltage of the toner sensing unit.

As can be seen in FIG. 13, if a paper P is to be printed, the amount of the toner recirculated by the recycling system is small and the particle size of the toner in developing device 75 is substantially constant to increase in the number of printing sheets. This is because an image forming rate is relatively high when the paper P is printed. Thus, a volumen of the toner in developing device 73 is substantially constant and the output signal TDs from toner sensing unit 33 of toner sensor 31 also is constant.

However, if an envelope E is to be printed, the amount of the toner remaining on photosensitive drum 59 after the transfer process is increased because of a low image forming rate, e.g., 1~2% compared with the above-described paper printing. Since such an increased amount of the toner is circulated between photosensitive drum 59 and developing device 75 and is stirred in developing device 75, the particle size of the toner tends to be decreased, and the average particle size of the toner in developing device 75 after 15,000 sheets printing is decreased about 20% of its initial average particle size, as shown in FIG. 21. An initial average particle size of the toner is about 11 μm and an average particle size thereof after 15,000 sheets printing is about 9 μm. In contrast with the decrease in the average particle size of the toner, the volume of the toner in developing device 75 increases, and the output voltage of toner sensing unit 33 increases, a compared with the initial voltage thereof. As shown in FIG. 14, the initial output voltage of toner sensing unit 33 is about 2.0 V, and the output voltage thereof after 15,000 sheets printing is about 3.0 V. In a conventional manner for determining the timing of the toner replenishment, an initial output voltage of toner sensing unit 33 is stored in the control section and the toner supply motor is operated to replenish the toner to the developing device if the output voltage of toner sensing unit 33 increases above a prescribed value from the initial output voltage thereof. When envelope E is to be printed, since the particle size of the toner in the developing device is decreased as described above, the output voltage of toner sensing unit 33 increases despite the constant value of the toner density in the developing device. If the toner is replenished based on the comparison result of the actual output voltage and the initial output voltage of toner sensing unit 33, the actual toner density in the developing device is excessively increased.

The inventors of the present invention derived the following equation from the result of experiments wherein the toner density in developing device 63 is maintained at 3.5%:

$$Y = \frac{Yp \times Cp + Ye \times Ce}{Cp + Ce} \quad (1)$$

wherein, Y is an output voltage of toner sensing unit 33 when paper P and envelope E are mixedly printed, Cp is the numbers of papers P printed, Ce is the number of envelopes E printed, Yp is the output voltage of toner sensing unit 33 when paper P is printed and Ye is the output voltage of toner sensing unit 33 when envelope E is printed.

Figure 18:
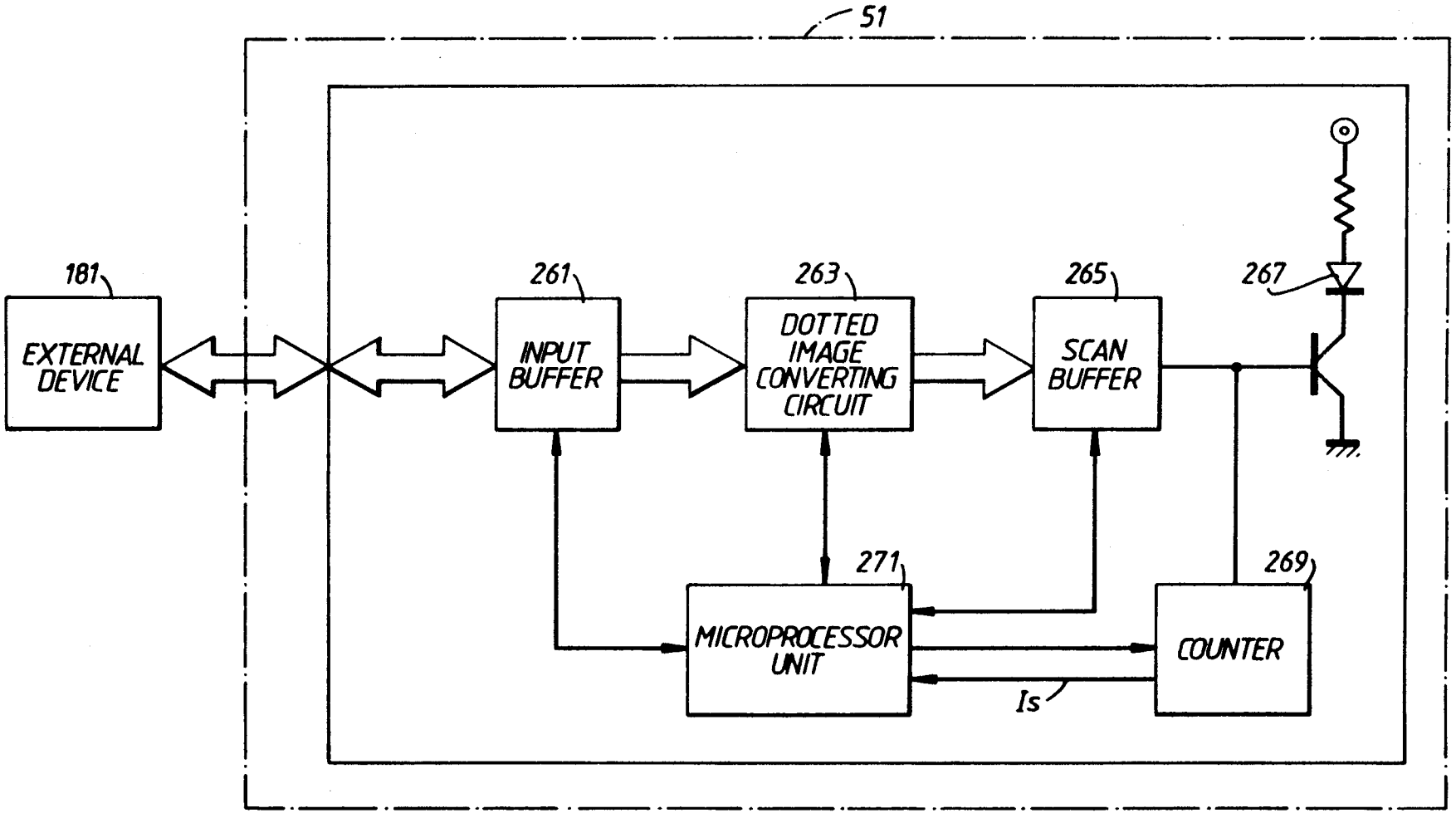
FIG. 18 is a block diagram illustrating the modification of the image forming apparatus of the one embodiment.

In addition, following TABLES II and III are respectively stored in a non-volatile memory 231 of central control section 183 shown in FIG. 18.

TABLE II

| Cp (sheet) | Yp (V) |
|---|---|
| 100 | 2.00 |
| 200 | 1.92 |
| . | . |
| . | . |
| . | . |
| 39,000 | 1.90 |

TABLE III

| Cp (sheet) | Yp (V) |
|---|---|
| 100 | 2.00 |
| 200 | 2.02 |
| . | . |
| . | . |
| . | . |
| 39,000 | 2.60 |

TABLE II and III are used to calculate the output voltage of toner sensing unit 33 by equation (1). The calculated value of the output voltage of toner sensing unit 33 is compared with an actual output voltage of toner sensing unit 33 in central control section 183 to determine the need for toner replenishment to developing device 75. TABLE II shows data when only envelopes E are to be printed and TABLE III shows data when only papers P are to be printed. Each output voltage of the Yp and the Ye in TABLES II and III are derived from FIGS. 20 and 21. Since the number of envelopes Ce is zero when only papers P are printed, the Y of equation (1) is equal to the Yp (the output voltage of toner sensing unit 33 when only papers P are printed). Thus, central control secion 183 determines the need for toner replenishment to developing device 75 in accordance with the actual output voltage of toner sensing unit 33. Also, when only envelopes E are printed, the Y of equation (1) is equal to Ye (the output voltage of toner sensing unit 33 when only envelopes E are printed). Thus, central control section 183 determines the need for toner replenishment to developing device 75 on the basis of the actual output voltage of toner sensing unit 33. When both papers P and envelopes E are printed, the output voltage of toner sensing unit 33 shown in FIG. 20 tends to move toward that shown in FIG. 14 depending on the number of envelopes E printed.

The relationship between the number of printed papers and envelopes and the average particle size of the toner in developing device 75 and the relationship between the number of printed papers and envelopes and the output voltage of toner sensing unit 33 when the same number of papers P and envelopes E are printed are shown in FIG. 15. For example, 200 sheets of envelopes E have been printed after 200 sheets of paper P were printed.

As shown in TABLES II and III, each output voltage Yp, Ye of toner sensing unit 33 is sampled at intervals of one hundred sheets. This is because changes in the average particle size of the toner are small if the sampling interval is determined between one hundred sheets and ten sheets in an envelope printing. The other reason is to save the capacity of non-volatile memory 231 in central control section 183. When the data of Yp and Ye shown in TABLES II and III is indicated by one byte unit (0~5 V) range and eight bit resolution capability), about eight hundred bytes are needed if the sampling interval of the data is every one hundred sheets and the sampling is executed up to fourty thousand sheets (the life of developing device 75). On the other hand, if the sampling interval is ten sheets, about eight thousand bytes are needed to store all of the data. If central control section 183 is formed with one-chip CPU, the capacity of non-volatile memory 231 is 16K bytes, in general. Thus, half of the capacity of non-volatile memory 231 is needed if the sampling interval of the data is every ten sheets.

As stated above, since the actual toner density in developing device 75 is estimated based on the output voltage of toner sensing unit 33 calculated in accordance with equation (1) when papers P and envelopes E are printed, an inappropriate toner replenishment caused by the actual output voltage of toner sensing unit 33 is avoided. Thus, the fogged image formed on an image forming medium can be avoided.

An initial output voltage Vi of toner sensing unit 33 tends to be dispersed in each developing device 75 within a range from 1 (V) to 3 (V) even if the toner density in each developing device 75 is a constant value, i.e., 3.5%. This is because the toner characteristics of one lot is slightly different from that of other lots. If the initial output voltage Vi of toner sensing unit 33 is one (V), the transition of the output voltage of toner sensing unit 33 against the number of printed image forming mediums, e.g., papers and envelopes, shown in FIGS. 13, 14 and 15 is shifted down by one (V). On the other hand, the transition of the output voltage of toner sensing unit 33 shown in FIGS. 13, 14 and 15 is shifted up by a prescribed value (V) if the initial output voltage Vi of toner sensing unit 33 is higher than the prescribed value, as compared with that shown in FIGS. 13, 14 and 15. Therefore, data shown in TABLES II and III also are modified based on changes in the initial output voltage vi of toner sensing unit 33.

Each number of papers taken out from paper cassettes 55*a*, 55*b* and 55*c* by the corresponding paper feed motors 189, 197 and 203 is counted and added as the number of printed papers CP. The number of envelopes taken out from envelope supply unit 57 by envelope feed motor 213 is counted as the number of printed envelopes Ce. The number of printed papers Cp and the number of printed envelopes Ce are stored in a second memory 233 arranged in central control section 183 shown in FIG. 18. However, those data Cp and Ce stored in second memory 233 are cleared when developing device 75 is changed, and the above-described data Cp and Ce are newly counted and stored in second memory 233.

Figure 16:
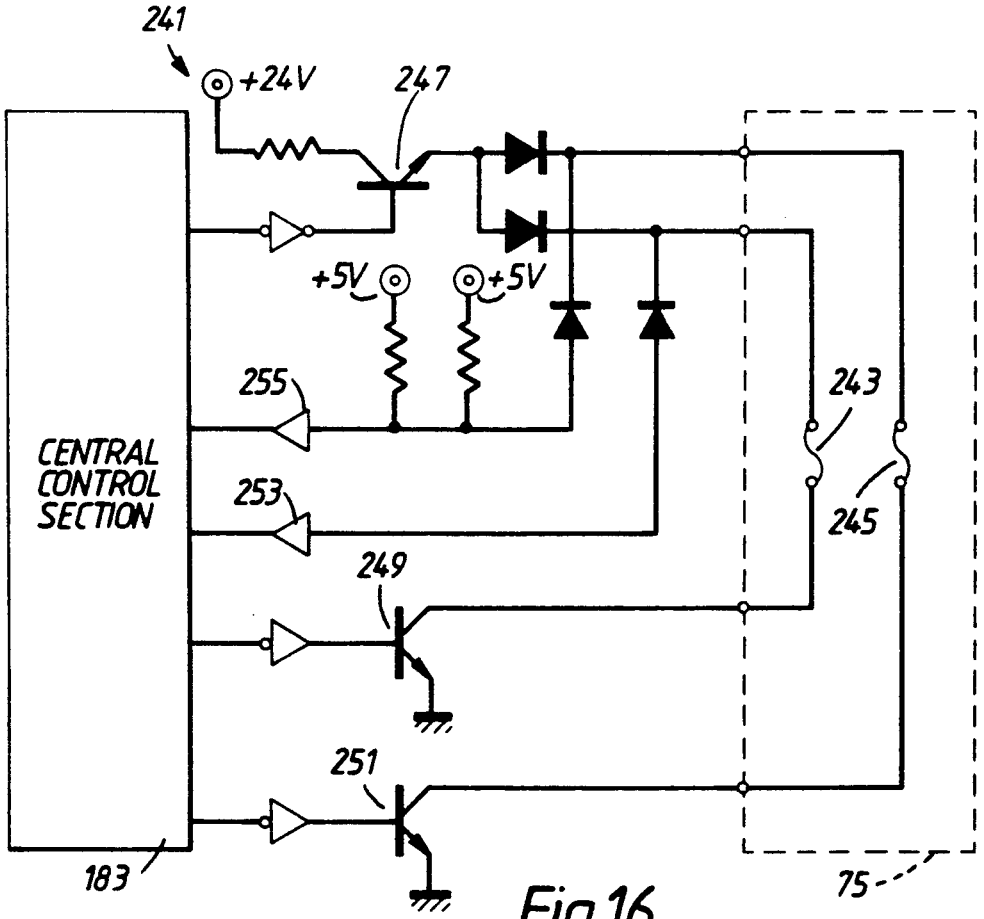
FIG. 16 is a circuit diagram illustrating an old/new discriminating circuit of the developing device.

An old/new discriminating circuit 241 of developing device 75 will be described with reference to FIG. 16. Developing device 75 is provided with an old/new indicating fuse 243 and a life termination indicating fuse 245. When developing device 75 is new, fuses 243 and 245 respectively maintain the conductivity. However, old/new indicating fuse 243 is melted down when developing device 75 is once in use. Life termination indicating fuse 245 is also melted down when the operational life of developing device 75 is ended. In this embodiment, the end of the operational life of developing device 75 is determined when the number of printed image forming mediums, e.g., papers and envelopes, reaches 40,000. As shown FIG. 16, old/new indicating fuse 243 is melted down by rendering transistors 247 and 249 on. Life termination indicating fuse 245 is melted down by rendering transistors 247 and 251 on. Central control section 183 detects whether or not old-/new indicating fuse 243 is melted down through transistor 249 and a buffer 253. Central control section 183 also detects through transistor 251 and a buffer 255 whether or not life termination indicating fuse 245 is melted down. Thus, if the conductive state of fuses 243 and 245 is detected, central control section 183 determines that developing device 75 is new and the data Cp and Ce (the number of printed papers P and the number of printed envelopes E) stored in second memory 233 shown in FIG. 11 is cleared. If the nonconductive state of only old/new indicating fuse 243 is detected, the counting of the data Cp and Ce is continued and the counted data Cp and Ce are stored in second memory 233. If the nonconductive state of both fuses 243 and 245 is detected, the data Cp and Ce stored in second memory 233 are maintained and the printing operation of image forming apparatus 51 is not carried out.

Figure 17:
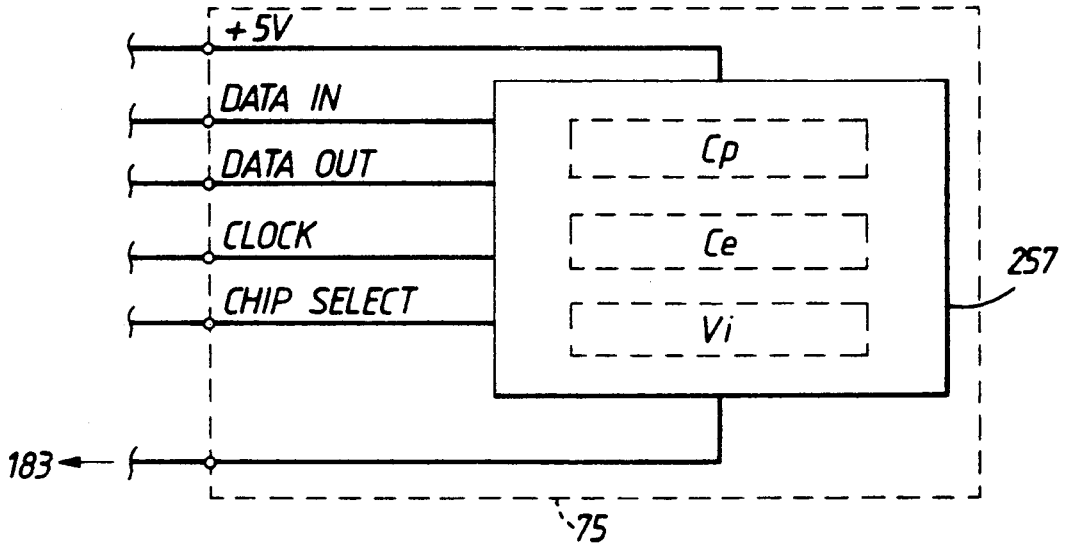
FIG. 17 is a schematic view of the modification of the developing device.

In the above-described embodiment, the data Cp and Ce are stored in second memory 233 of central control section 183. However, as shown in FIG. 17, developing device 75 may be provided with a non-volatile memory 257 wherein the data Cp and Ce are stored. In this case, a plurality of developing devices may be selectively used in parallel. Central control section 183 of image forming apparatus 51 properly controls the toner density of the developing device 75 even if the developing device presently used in the image forming apparatus 51 is changed to a previously used developing device. This is because each developing device 75 maintains respective data Cp and Ce in the memory 257 thereof and the central control section 183 of image forming apparatus 51 controls the toner density of the presently used developing device 75 based on its own data Cp and Ce stored in the memory 257 of the subject developing device 75. In addition, an initial output voltage Vi of toner sensing unit 33 may also be stored in memory 257 of developing device 75. In this case, the data Yp and Ye of TABLES II and III stored in memory 231 are modified based on the initial output voltage Vi of toner sensing unit 33.

As stated above, the toner replenishment is carried out when the toner density in developing device 75 is low, as compared with the prescribed level. However, the toner in developing device 75 is forcibly consumed when the toner density in developing device 75 is high. One conventional image forming apparatus may be a copying device and another conventional image forming apparatus may be a printing device. In the conventional copying device, a document having a high image forming ratio, e.g., an entire surface printed in a solid-black state, is repeatedly copied to consume the toner in developing device 75. This operation results a decrease in the toner density. In the conventional printing device, the printing operation is repeatedly carried out in accordance with data having a high image forming ratio fed from a host computer or a wordprocessing apparatus. The printing operation is also carried out on the basis of one hundred percent solid-black test pattern data or fifty percent solid-black test pattern data stored in the printing device.

However, in the above described toner consuming operations, the user has to visually estimate an optimum toner density in developing device 75 during the copying or printing operation. Thus, it is difficult to determine the optimum toner density in developing device 75 by visually inspecting the copied or printed document.

Figure 12:
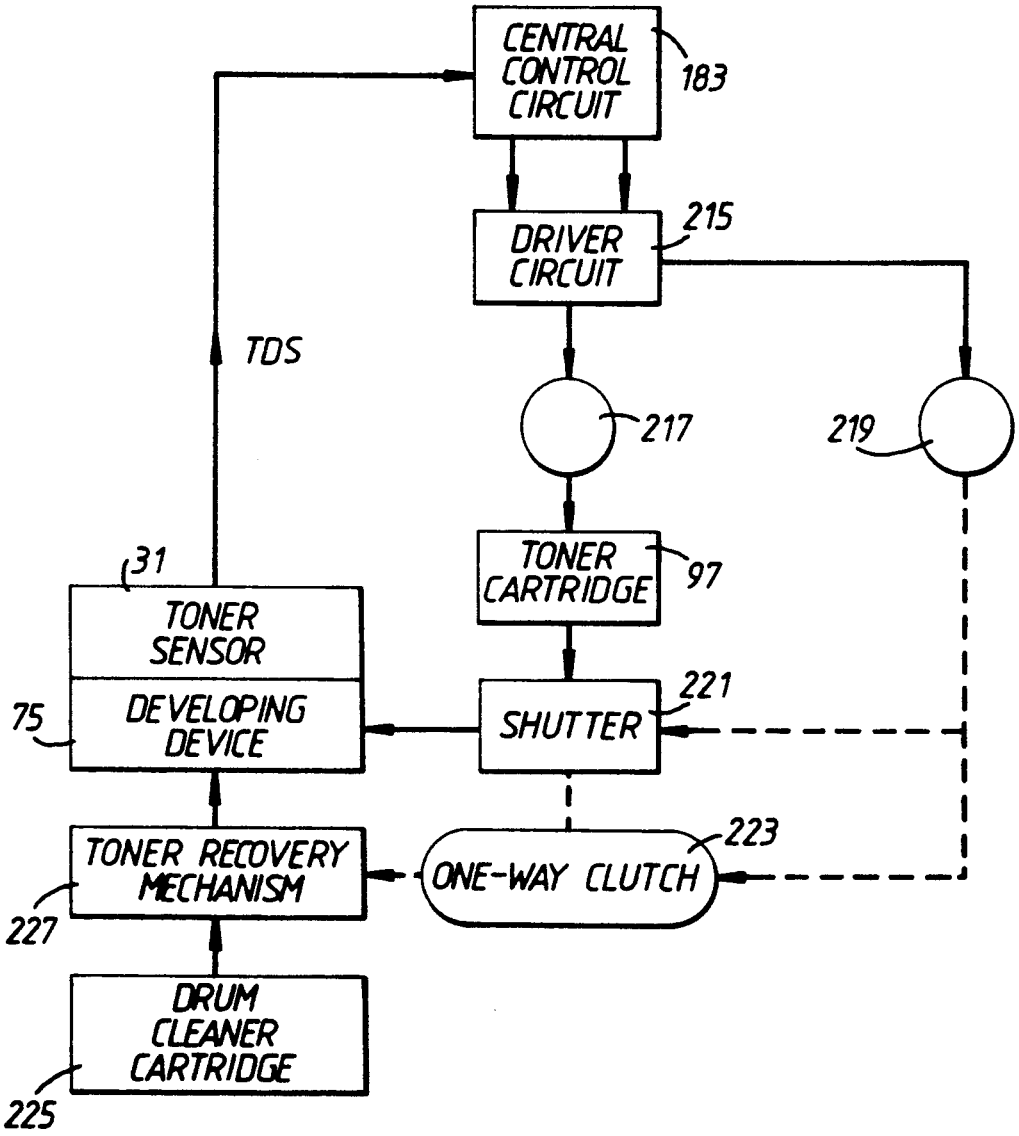
FIG. 12 is a block diagram illustrating the toner density control operation of the image forming apparatus shown in FIGS. 2 and 3.

In the above-described one embodiment, when the output voltage of sensing unit 31 is less than fifty percent of the value Y obtained by the above-described equation (1), the indication, e.g., OVER TONER, is executed in a display panel 205*a* of operation section 205 shown in FIG. 12 to indicate a high toner density in developing device 75. The above-described toner consuming operation is carried out until the output voltage of sensing unit 31 is increased to be greater than eighty percent of the value Y obtained by the equation (1). In this case, the above-described ratios, i.e., 80% and 50%, may be modified to every models of the image forming apparatus by the experiments. The above-described toner consuming operation may be manually started by operating a specific key (not shown) arranged in operation section 205 when the "OVER TONER" is indicated in display panel 205*a*. In this case, if the user intends to print a document having a high image forming ratio, the toner density in developing device 75 is automatically decreased by carring out the printing operation.

A modification of image forming apparatus 51 will be described with reference to FIG. 18. When image data is fed from external device 181, e.g., a computer, a word processing device, etc., to image forming apparatus 51, the image data is stored in an input buffer 261. The data stored in buffer 261 is further transmitted to a dotted image converting circuit 263 to convert the image data to dotted image data. The dotted image data is fed to a scan buffer 265 and then is further fed to image forming unit 267 to drive an scanning device (not shown). The dotted image data is also fed from scan buffer 265 to a counter 269. The dotted image data is composed of binary signals (10100 . . . ). Any one level signal of binary signals is counted by counter 269. When the counted value achieves a prescribed value, an interrupting signal Is is fed from counter 269 to microprocessor unit 271. The prescribed value is data corresponding to an image forming ratio which is determined to each size of an image forming medium. When microprocessor unit 271 receives the interrupting signal Is, a high image forming ratio of the image data is determined by microprocessor unit 271. Thus, microprocessor unit 271 estimates that the present printing operation is executed on a paper P, and Cp (the number of printed papers P) is increased in response to the interrupting signal Is to estimate the toner density in developing device 75 by equation (1). On the other hand, if no interrupting signal Is is generated by counter 269, microprocessor unit 271 estimates that the present printing operation is executed on an envelope E, and Ce (the number of printed envelopes E) is increased.

With the above-described modification, the image forming ratio to an image forming medium is determined by counting the dotted image data printed on the image forming medium. The interrupting signal Is is issued from counter 269 everytime the counted value achieves the prescribed value. When the interrupting signal Is is issued, microprocessor unit 271 estimates that paper P is to be printed. Otherwise, microprocessor unit 271 estimates that envelope E is to be printed. It is not required to estimate the image forming ratio on the basis of the difference of paper supply unit 55 or envelope supply unit 57 from which paper P or envelope E is taken out. Thus, no specific supply unit is needed and envelope supply unit 57 may be used to store papers P. Constructions other than the above and Operations thoseof after the above-described estimating operation is executed are similar to those in the first embodiment, and therefore the detailed descriptions thoseof should be referred to the first embodiment.

Figure 19:
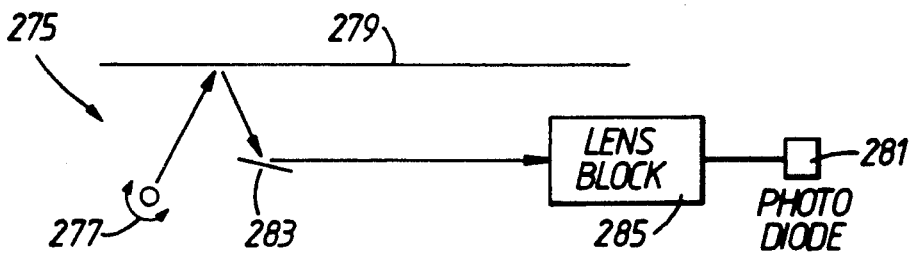
FIG. 19 is an explanatory view illustrating the optical scan operation of a conventional image forming apparatus.
Figure 20:
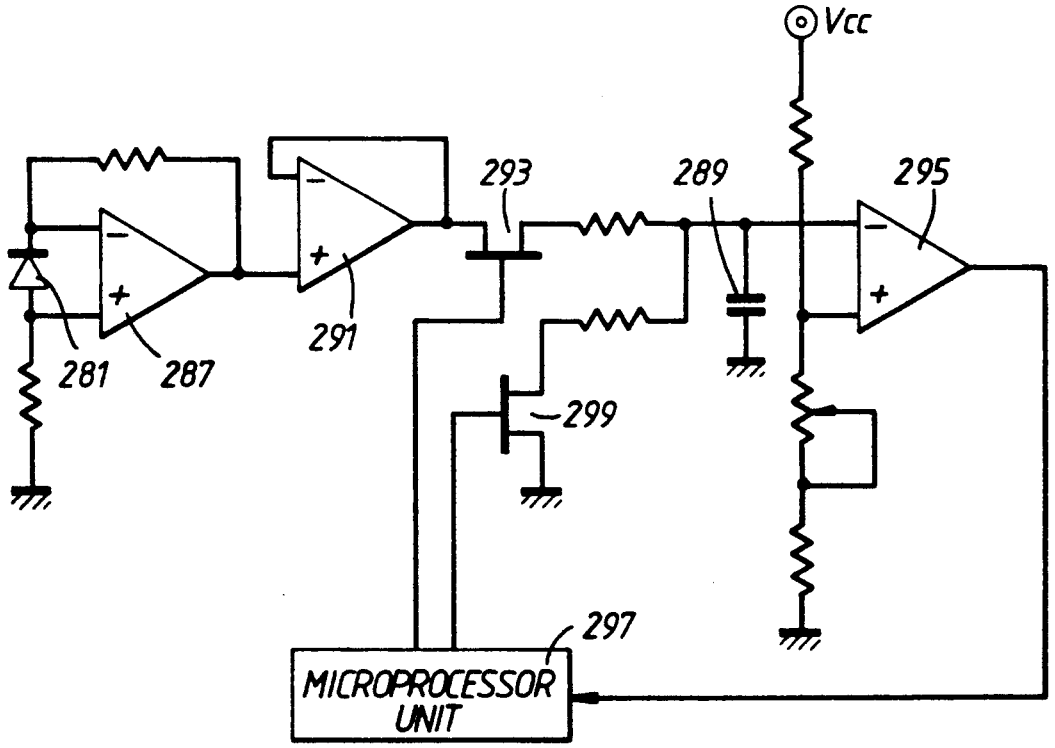
FIG. 20 is a circuit illustrating the modification of the image forming apparatus of the one embodiment.

Another modification of image forming apparatus 51 will be described with reference to FIGS. 19 and 20. As shown in FIG. 16, image forming apparatus 275 includes an optical scanner to read an image formed on a document. In this modification, since the image forming operation thereof is similar to that of the conventional copying apparatus, only an image forming ratio detecting operation is described.

A light fed from an illuminating lamp 277 is reflected from a document 279 on which an image is formed, and enters into a photo-diode 281 through a mirror 283 and a lens block 285. As shown in FIG. 20, the light entering the photo-diode 281 is converted to a voltage by an operational amplifier 287. Then, the voltage output from operational amplifier 287 charges capacitor 289 through a buffer 291 and a switching transistor 293. The charged voltage on capacitor 289 is substantially proportional to the image forming ratio of the document 279. Thus, if a low level signal is input from a comparator 295 to a microprocessor unit 297, microprocessor unit 297 estimates that a paper P is to be printed. Otherwise, microprocessor unit 297 determines that an envelope E is to be printed. Based on the above-described determinations, microprocessor unit 297 counts the number of printed papers Cp or the number of printed envelopes CE. As a result, the need of the toner replenishment to developing device 75 can be determined by the above-described equation (1). The charged voltage on capacitor 289 is discharged through a switching transistor 299. Constructions other than the above and Operations thoseof after the above-described estimating operation is executed are similar to those in the first embodiment, and therefore the detailed descriptions thoseof should be referred to the first embodiment.

With the present invention, since the toner density in the developing device is maintained at a substantially constant value even through papers and envelopes are mixtedly printed, a clear image is obtained for an operational period.

The present invention has been described with respect to a specific embodiment. However, other embodiments based on the principles of the present invention should be obvious to those or ordinary skilled in the art. Such embodiment are intended to be covered by the claims.

What is claimed is:

1. An image forming apparatus comprising:

means for selectively supplying a first image forming medium and a second image forming medium different from the first image forming medium;

image forming means, including a developing device in which a two component developing agent including a toner and a carrier is stored at a prescribed toner density, for forming a visible image on one of the first image forming medium and the second image forming medium with the toner;

means for storing the toner of the two component developing agent;

toner supplying means for replenishing the toner in the storing means to the developing device;

means for respectively counting the number of first image forming mediums and second image forming mediums supplied to the image forming means;

memory means for storing data of a relationship of a prescribed voltage value data against the number of first image forming medium (Cp) supplied to the image forming means and the number of second image forming mediums (Ce) supplied to the image forming means, the prescribed voltage value data being proportional to changes in the toner density in the developing device;

means for estimating the toner density in the developing device based on the respective count value of first and second image forming mediums in the counting means and the data in the memory means; and control means responsive to the estimating means for activating the toner supply means to regulate the toner density in the developing device.

2. An apparatus according to claim 1, further including toner sensor means for outputting a detection voltage signal of a first volatge value (Yp) proportional to changes in the toner density of the two component developing agent in the developing device when the image forming operation is carried out on the first image forming medium and the detection voltage signal of second voltage value (Ye) proportional to changes in the toner density of the two component developing agent in the developing device when the image forming operation is carried out on the second image forming medium, the detection voltage signal being unproportional to changes in the toner density of the two component developing agent in the developing device when the image forming operation is selectively carried out to the first and second image forming mediums.

3. An apparatus according to claim 2, wherein the prescribed voltage value data in the memory means have the first voltage value (Yp) of the detection voltage signal of the toner sensor means against changes in the number of first image forming mediums on which the image is formed and the second voltage value (Ye) of the detection voltage signal against changes in the number of second image forming mediums on which the image is formed and the estimating means includes means for calculating a value (Y) by the following equation:

$$Y = \frac{Yp \times Cp + Ye \times Ce}{Cp + Ce}$$

4. An apparatus according to claim 1 further including means for detachably supporting the image forming means in the image forming apparatus.

5. An apparatus according to claim 4, wherein the image forming means includes second memory means for storing the respective count value of first and second image forming mediums in the counting means.

6. An apparatus according to claim 5, wherein the image forming means further includes third memory means for storing an initial voltage value of the detection voltage signal of the toner sensor means when the image forming means is initially used in the image forming apparatus.

7. An apparatus according to claim 6, wherein the control means includes means for modifying the first voltage value (Yp) or the second voltage value (Ye) based on the initial voltage value of the detection voltage signal when the estimating means calculates the value (Y).

8. An apparatus according to claim 4, wherein the image forming means includes means for indicating that the image forming means has been used.

9. An apparatus according to claim 8, wherein the control means includes sub control means for activating the indicating means when the image forming means is initially used in the image forming apparatus.

10. An apparatus according to claim 9, wherein the control means further includes means for clearing the respective count value of the number of first image forming mediums and second image mediums of the counting means.

11. An image forming apparatus comprising:

means for supplying an image forming medium;

image forming means, includes a developing device in which a two component developing agent including a toner and a carrier is stored at a prescribed toner density, for forming a visible image on the image forming medium with the toner on the basis of image data from an external apparatus;

means for storing the toner of the two component developing agent;

toner supplying means for replenishing the toner in the storing means to the developing device;

means for converting the image data to dotted image data composed of binary signals having a (1) signal and a (0) signal;

means for counting the (1) signals of the dotted image data;

means for outputting an interrupting signal when the counting means achieves a predetermined value;

first memory means for storing first data (Cp) and second data (Ce);

second memory means for storing data of a relationship of prescribed voltage values against the first data (Cp) and the second data (Ce), the prescribed voltage values being proportional to the toner density in the developing device;

means for increasing the first data in the first memory means when the interrupting signal is issued from the outputting means and increasing the second data in the first memory means when no interrupting signal is issued;

means for estimating the toner density in the developing device based on the first and second data in the first memory means and the data in the second memory means; and control means responsive to the estimating means for activating the toner supply means to regulate the toner density in the developing device.

12. An apparatus according to claim 11, wherein the image forming medium includes a sheet of paper and an envelope.

13. An apparatus according to claim 12, further including toner sensor means for outputting a detection voltage signal of a first voltage value (Yp) proportional to changes in the toner density of the two component developing agent in the developing device when the image forming operation carried out on the paper and the detection voltage signal of a second voltage value (Ye) proportional to changes in the toner density of the two component developing agent in the developing device when the image forming operation carried out on the envelope, the detection voltage signal being unproportional to changes in the toner density of the two component developing agent in the developing device when the image forming operation is selectively carried out on the paper and the envelope.

14. An apparatus according to claim 13, wherein the prescribed voltage value data in the second memory means have the first voltage value (Yp) of the detection voltage signal of the toner sensor means against changes in the number of papers supplied to the image forming means and the second voltage value (Ye) of the detection voltage signal agaist changes in the number of envelopes supplied to the image forming means, and the estimating means includes means for calculating a value (Y) by the following equation:

$$Y = \frac{Yp \times Cp + Ye \times Ce}{Cp + Ce}$$

15. An image forming apparatus comprising:

means for supplying an image forming medium scan means for producing a light signal corresponding to image data by scanning a document;

image forming means, including a developing device in which a two component developing agent including a toner and a carrier is stored at a prescribed toner density, for forming a visible image on the image forming medium with the toner on the basis of the light signal from the scan means;

means for storing the toner of the two component developing agent;

toner supplying means for replenishing the toner in the storing means to the developing device;

means for producing a converted voltage based on the light signal fed from the scan means;

means for storing charges by the converted voltage from the producing means;

means for outputting a prescribed level signal when the charges in the storing means achieves a predetermined value;

first memory means for storing first data (Cp) and second data (Ce);

second memory means for storing data of a relationship or prescribed voltage values against the first data (Cp) and the second data (Ce), the prescribed voltage values being proportional to the toner density in the developing device;

means for increasing the first data in the first memory means when the prescribed level signal is issued from the outputting means and for increasing the second data in the first memory means when no prescribed level signal is issued;

means for estimating the toner density in the developing device based on the first and second data in the first memory and the data in the second memory means; and control means responsive to the estimating means for activating the toner supply means to regulate the toner density in the developing device.

16. An apparatus according to claim 15, wherein the image forming medium includes a sheet of paper and an envelope.

17. An apparatus according to claim 16, further including toner sensor means for outputting a detection voltage signal of a first voltage value (Yp) proportional to changes in the toner density of the two component developing agent in the developing device when the image forming operation is carried out on the paper and the detection voltage signal of a second voltage value (Ye) proportional to changes in the toner density of the two component developing agent in the developing device when the image forming operation is carried out on the envelope, the detection voltage signal being unproportional to changes in the toner density of the two component developing agent in the developing device when the image forming operation is selectively carried out on the paper and the envelope.

18. An apparatus according to claim 17, wherein the prescribed voltage value data in the second memory means have the first voltage value (Yp) of the detection voltage signal of the toner sensor means against changes in the number of papers supplied to the image forming means and a second voltage value (Ye) of the detection voltage signal against changes in the number of envelope supplied to the image forming means, the estimating means includes means for calculating a value (Y) by the following equation:

$$Y = \frac{Yp \times Cp + Ye \times Ce}{Cp + Ce}.$$

* * * * *